US005241771A

United States Patent [19]

Caustic

[11] Patent Number: 5,241,771

[45] Date of Patent: Sep. 7, 1993

[54] STEADY-HOLD SHOOTERS REST (PLASTIC)

[76] Inventor: Dennison M. Caustic, 2305 Jungle St., Lakeland, Fla. 33801

[21] Appl. No.: 924,511

[22] Filed: Aug. 4, 1992

[51] Int. Cl.[5] ..... F41A 23/00

[52] U.S. Cl. ..... 42/94

[58] Field of Search ..... 42/94; 89/57.04

[56] References Cited

U.S. PATENT DOCUMENTS

| | | | |
|---|---|---|---|
| 759,593 | 5/1904 | Cover | 42/94 |
| 889,548 | 5/1908 | Burnough | 42/94 |
| 915,481 | 3/1909 | Roop | 42/94 |
| 941,640 | 11/1909 | Lawson | 42/94 |
| 1,497,794 | 6/1924 | Saunders | 42/94 |
| 3,200,528 | 8/1965 | Christensen | 42/94 |
| 3,390,477 | 7/1968 | Galbrath | 42/94 |
| 4,515,301 | 5/1985 | A'Costa | 42/94 |
| 5,060,409 | 10/1991 | Caustic | 42/94 |

*Primary Examiner*—David H. Brown

[57] ABSTRACT

The Steady-Hold Shooters Rest (Plastic) is an improved rest designed to provide a shooter with a steady hold on a target by incorporating the individual's total body strength and weight into maintaining a steady hold while moving the aiming point in a smooth, continuously supported manner as required by the situation encountered while hunting or shooting. This steady hold feature is accomplished by the use of an elliptical armrest bar and top deck molded to a solid body support bracket which is in turn fastened around the waist of the shooter and positioned directly in front of him/her so that the armrest bar extends to the shooter's sides at close proximity while extending at greater distance from the shooter's body as it approaches the center point of the rest. The shooter has steady hold when his/her arm supporting the weapon at the fore end is placed in contact with the armrest bar or the solid top deck of the rest.

4 Claims, 4 Drawing Sheets

STEADY-HOLD SHOOTERS REST (PLASTIC)

TECHNICAL FIELD OF THE INVENTION

This invention pertains to the category of fire arms accessories, more particularly to rests.

DESCRIPTION OF THE PRIOR ART

This application is for an improved version of Steady-Hold Shooters Rest. U.S. Pat. No. 5060409 held by this inventor.

SUMMARY OF THE INVENTION

The Steady-Hold Shooters Rest (Plastic) is worn around and in front of the waist of the shooter, thereby moving with the shooter as an appendage. It requires no adjustment and therefore provides rapid aiming at moving targets and allows instant following of the target, while giving a shooter a steady hold even if the weapon is held in firing position for several minutes. The device is designed to automatically compensate for changes in the distance of a shooter's support arm from his body as he/she changes from a side shooting stance to a frontal shooting stance or vice-versa. A shooter wearing this device can shoot from any position except the prone position. The device can be used by shooters who shoot either left or right handed, left handed only, or right handed only. This device is extremely versatile for firing any shoulder type weapon, including crossbows, in almost all shooting situations requiring rapid target acquisition and steady hold. The Steady-Hold Shooters Rest (Plastic) differs from the Steady-Hold Shooters Rest in that the armrest bar is shortened on each side to terminate at the ends of the body support bracket. The new rest is also molded with a solid body support bracket, side gussets and front gusset. The armrest bar is changed to a hollow half-round instead of solid bar and is molded with a solid top deck between the arm rest bar and the body support bracket.

DESCRIPTION OF PREFERRED EMBODIMENTS

Figure 1:
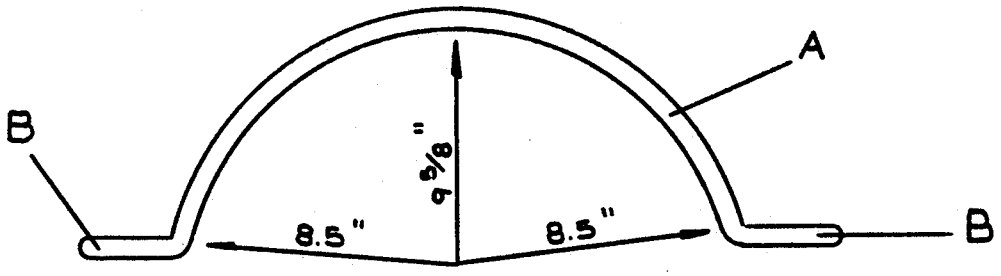
FIG. 1—Top of body support bracket (A) with side gussets (B). The radius of the curve is also depicted.

Referring to the drawings, wherein like reference characters designate like or corresponding parts throughout the several views, there is shown in;

FIG. 1—The top view of the solid molded body support bracket (A) which is 18" long and 7" high, tapered from ¼" thick at the bottom to ⅜" thick at top, and curved to radius shown. Side gussets (B) are 2" wide at top and extend along each side of the body support bracket (A). The side gussets (B) are also ¼" thick at bottom and ⅜" thick at top.

Figure 2:
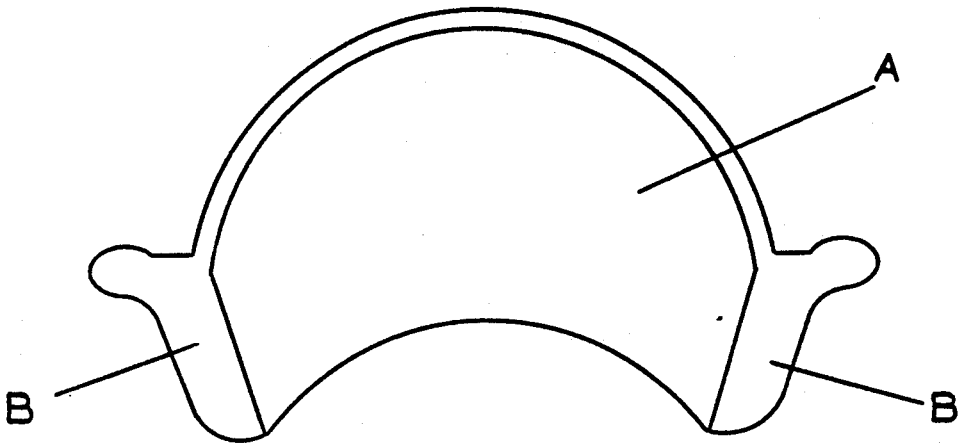
FIG. 2—View of body support bracket (A) with side gussets (B) as it is positioned on shooter. Body support bracket (A) is molded solid.

FIG. 2—The body support bracket (A) with side gussets (B) in an upright position (as it would be positioned against the shooters waist).

Figure 3:
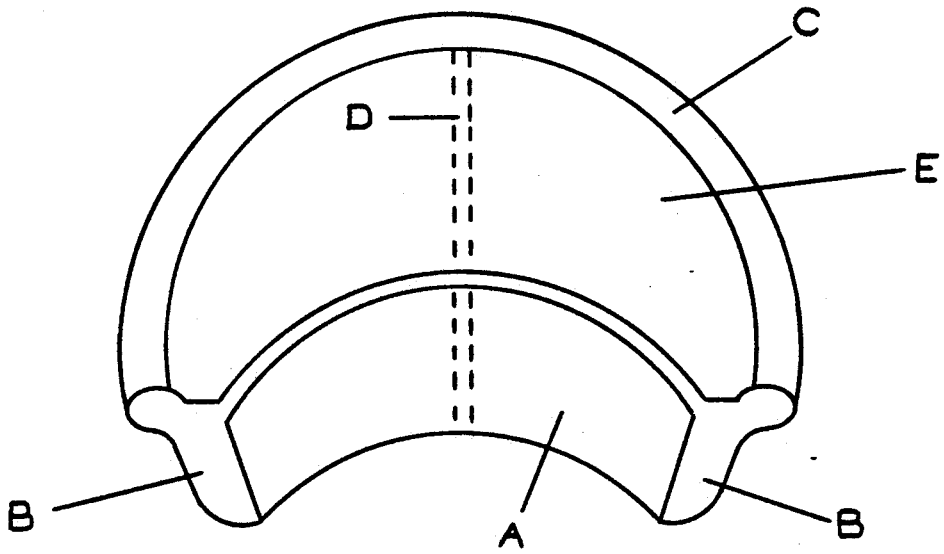
FIG. 3—Body Support bracket (A) with side gussets (B), front gusset (D) armrest bar (C) and molded top deck (E) between body support bracket (A) and armrest bar (C).

FIG. 3—The addition of front gusset (D), which is also tapered from ¼" thick at bottom to ⅜" thick at top, and armrest bar (C) which is a hollow half-round and elliptically formed to connect with front gusset (D) and spaced 4" in front of the body support bracket (A) at its center, and to connect with side gussets (B) at ½" from each end of the body support bracket (A), and a molded top deck (E) fills space between arm rest bar (C) and body support bracket (A).

Figure 4:
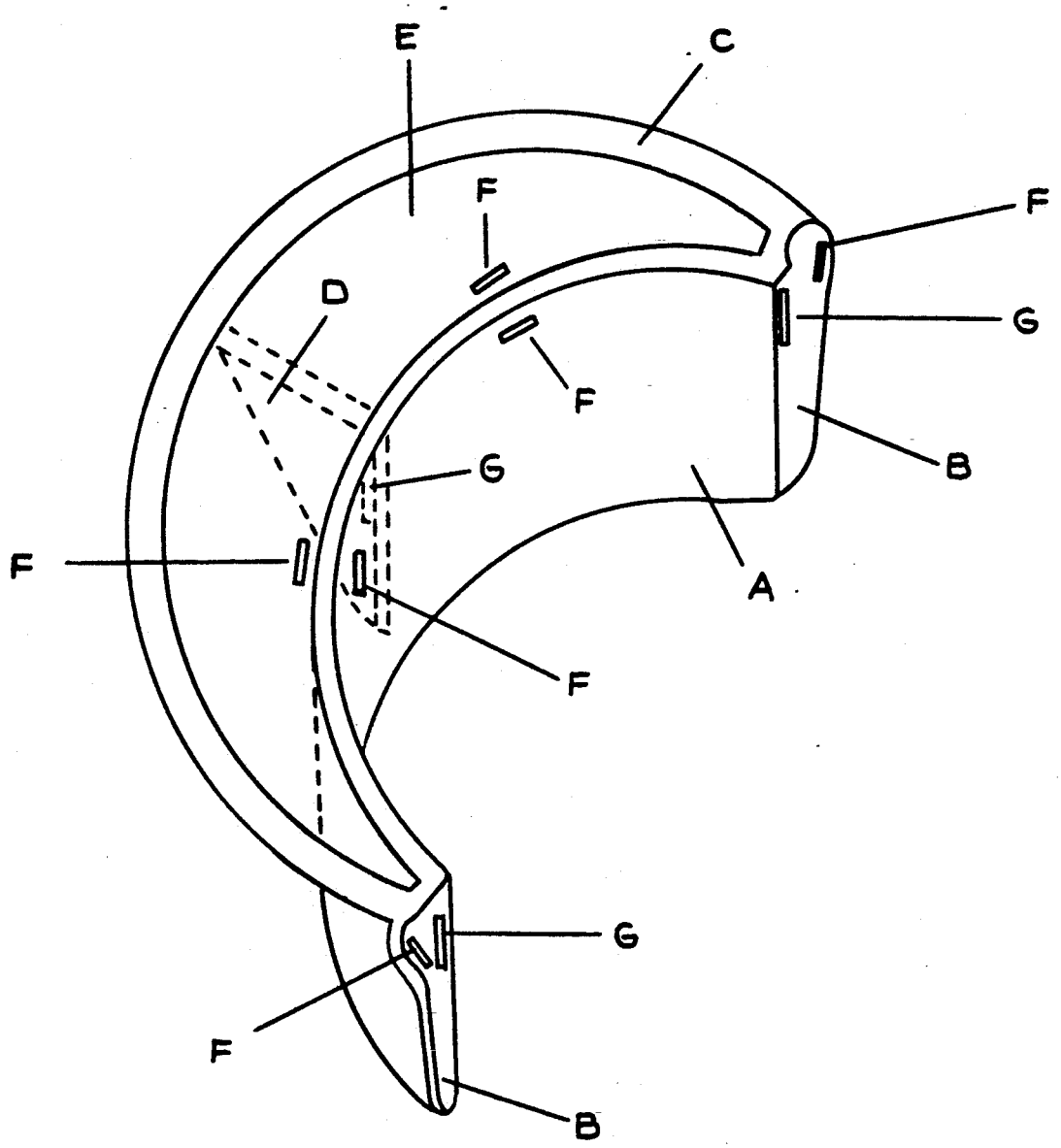
FIG. 4—Perspective view of Steady-Hold Shooters Rest (Plastic) showing relationship of all the parts and the location of three waist belt slots (G) and six shoulder strap slots (F).

FIG. 4—The relationship of all parts including the location of the three ¼"×2⅛" waist belt slots (G) and the six ⅛"×1⅛" shoulder strap slots (F). The rest is molded from plastic in one piece and therefore eliminates the need for mechanical fasteners.

Figure 5:
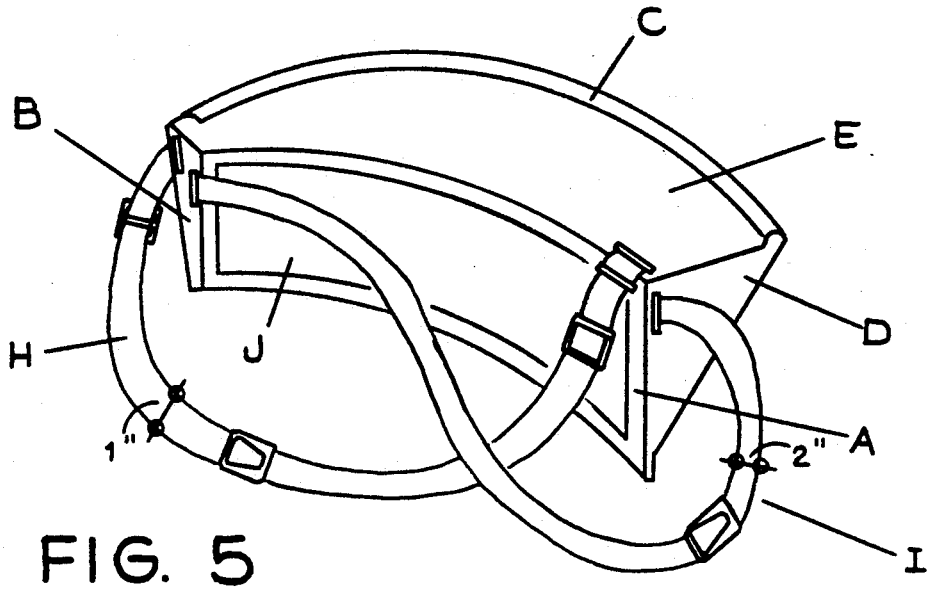
FIG. 5—View of half rest as used to shoot right handed only. Also shown are the 2" waist belt (I), the 1" shoulder strap (H) and a ventilated body bracket (A). The ventilation opening is marked (J).

FIG. 5—The left half of the steady-hold shooters rest for use by right handed shooters showing relationship of all the parts and the location for inserting the 2" waist belt (I) and the 1" shoulder strap (H). The body bracket can also be ventilated by removing a panel (J) leaving a minimum of 1" of material all around the opening.

Figure 6:
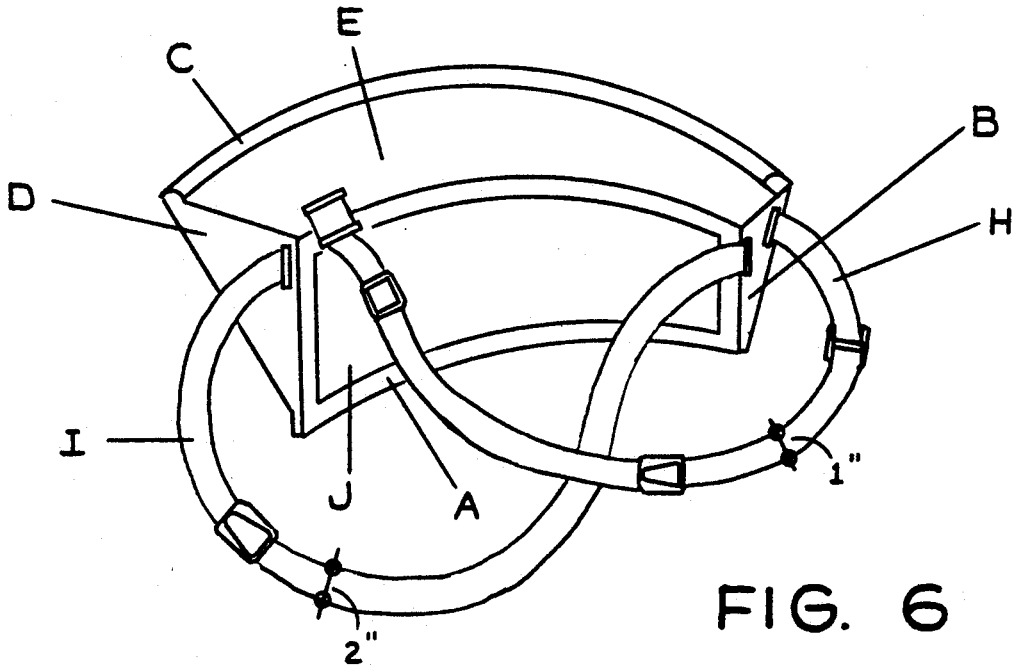
FIG. 6—View of half rest as used to shoot left handed only. Also shown are the 2" waist belt (I), the 1" shoulder strap (H) and a ventilated body bracket (A). The ventilation opening is marked (J).

FIG. 6—The right half of the steady-hold shooters rest for use by the left handed shooters showing relationship of all the parts and the location for inserting the 2" waist belt (I) and the 1" shoulder strap (H). The body bracket (A) can also be ventilated by removing a panel (J) leaving a minimum of 1" of material all around the opening (J).

Figure 7:
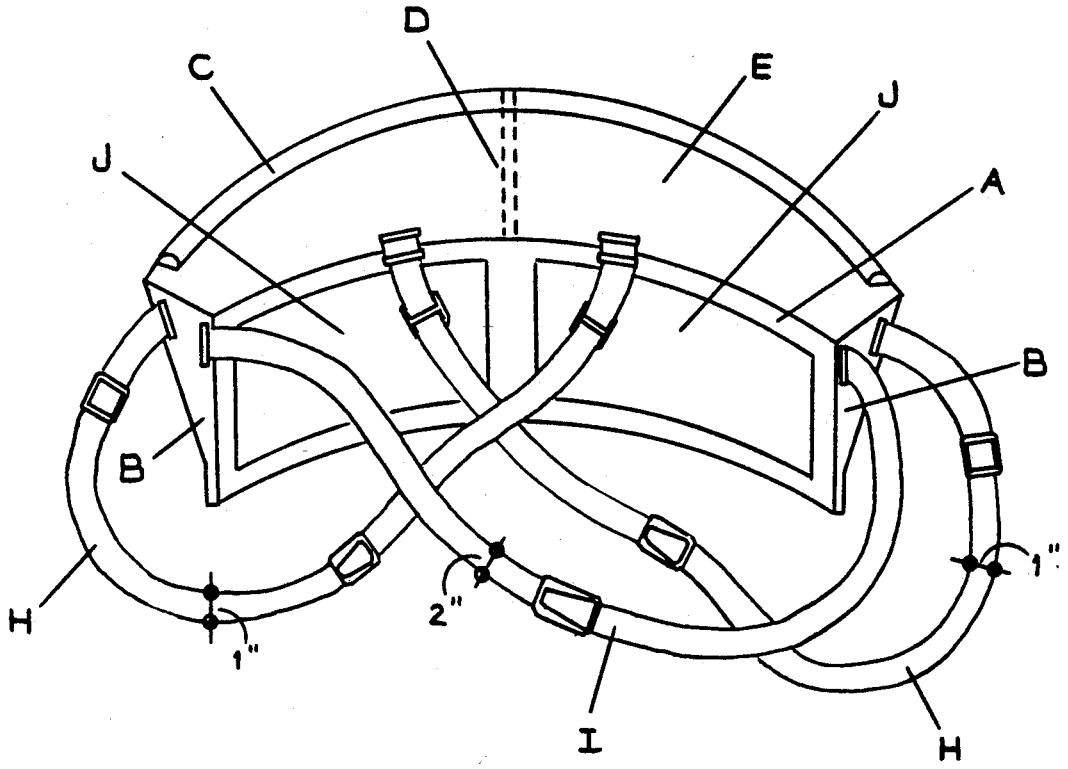
FIG. 7—Viewo f whole rest for left and right hand shooting. Also shown are the 2" waist belt (I), the 1" shoulder straps (H) and a ventilated body bracket (A). The ventilation openings (2) are marked (J). Two shoulder straps (H) are required.

FIG. 7—View of the whole steady-hold shooters rest for use by left and right hand shooters showing relationship of all the parts and the location for inserting the 2" inch waist belt (I) and the 1" shoulder straps (H). There are two shoulder straps (H). The body bracket (A) is ventilated by removing a portion of each side of the body bracket (A) leaving a minimum of 1" of material around both openings (J).

What is claimed and desired to be secured by letters patent of the United States is:

1. A shooting rest comprising: a solid molded body support bracket formed on a radius and incorporating two side gussets and a front gusset at the center; a hollow half-round armrest bar molded elliptically and connected to the top of the body support bracket by the front gusset at its center and to each side gusset at its ends and a solid top deck; and said shooting rest having a belt for securing the body support bracket to a shooter's waist, and shoulder straps for positioning the rest higher or lower on the shooter's waist.

2. A shooting rest as claimed in claim 1 wherein said rest is sized proportionately to fit various sized shooters.

3. A shooting rest as claimed in claim 1 wherein said rest is molded or cut as a left or right hand model only.

4. A shooting rest as claimed in claim 1 wherein said rest is made with a ventilated body support bracket.

* * * * *